US006644769B2

(12) United States Patent
Numata

(10) Patent No.: US 6,644,769 B2
(45) Date of Patent: Nov. 11, 2003

(54) RECORDING METHOD AND RECORDING APPARATUS

(75) Inventor: Yasuhiro Numata, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/042,267

(22) Filed: Jan. 11, 2002

(65) Prior Publication Data

US 2002/0101466 A1 Aug. 1, 2002

(30) Foreign Application Priority Data

Jan. 31, 2001 (JP) ..... 2001-023846

(51) Int. Cl.[7] ..... B41J 29/38

(52) U.S. Cl. ..... 347/13; 347/5; 347/42; 347/43

(58) Field of Search ..... 347/13, 43, 42, 347/5, 41

(56) References Cited

U.S. PATENT DOCUMENTS 5,382,101 A 1/1995 Iguchi ..... 400/124.03
5,587,730 A 12/1996 Karz ..... 347/43
6,260,947 B1 * 7/2001 Pinkernell ..... 347/43
2001/0026304 A1 * 10/2001 Matsuzaki et al. ..... 347/85

FOREIGN PATENT DOCUMENTS

EP 0 917 961 5/1999

* cited by examiner

*Primary Examiner*—Judy Nguyen
*Assistant Examiner*—Lam Nguyen
(74) *Attorney, Agent, or Firm*—Fitzpatrick, Cella, Harper & Scinto

(57) ABSTRACT

A recording apparatus using full-line type ink jet recording heads needs a large amount of electrical power for ink ejection due to a large number of nozzles of the recording heads. Therefore, a power supply capacity of the recording apparatus needs to be increased, resulting in increase in an overall apparatus cost. When simultaneously recording on plural recording media using a recording apparatus having recording heads with different electrical power consumptions arranged in a transfer direction of the recording media, recording is performed so that the recording heads to be simultaneously driven are combined so as to be a combination of the recording heads with different electrical power consumptions.

13 Claims, 11 Drawing Sheets

FIG. 3A

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 50 | 60 | 60 | 60 | 50 |
| t1 | 220 | 50 | 60 | 60 | X | 50 |
| t2 | 220 | 50 | 60 | X | 60 | 50 |
| t3 | 220 | 50 | X | 60 | 60 | 50 |
| t4 | 180 | X | 60 | 60 | 60 | X |

FIG. 3B

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 50 | 60 | 60 | 50 | 60 |
| t1 | 230 | 50 | 60 | 60 | X | 60 |
| t2 | 220 | 50 | 60 | X | 50 | 60 |
| t3 | 220 | 50 | X | 60 | 50 | 60 |
| t4 | 170 | X | 60 | 60 | 50 | X |

FIG. 3C

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 50 | 60 | 50 | 60 | 60 |
| t1 | 220 | 50 | 60 | 50 | X | 60 |
| t2 | 230 | 50 | 60 | X | 60 | 60 |
| t3 | 220 | 50 | X | 50 | 60 | 60 |
| t4 | 170 | X | 60 | 50 | 60 | X |

FIG. 3D

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 50 | 50 | 60 | 60 | 60 |
| t1 | 220 | 50 | 50 | 60 | X | 60 |
| t2 | 220 | 50 | 50 | X | 60 | 60 |
| t3 | 230 | 50 | X | 60 | 60 | 60 |
| t4 | 170 | X | 50 | 60 | 60 | X |

FIG. 3E

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 60 | 50 | 50 | 60 | 60 |
| t1 | 220 | 60 | 50 | 50 | X | 60 |
| t2 | 230 | 60 | 50 | X | 60 | 60 |
| t3 | 230 | 60 | X | 50 | 60 | 60 |
| t4 | 160 | X | 50 | 50 | 60 | X |

FIG. 5A

| TIME | TOTAL ELECTRIC POWER-CONSUMPTION | FOURTH HEAD | THIRD HEAD | SECOND HEAD | FIRST HEAD |
|---|---|---|---|---|---|
| | | 40 | 60 | 60 | 50 |
| t1 | 150 | 40 | 60 | X | 50 |
| t2 | 150 | 40 | X | 60 | 50 |
| t3 | 120 | X | 60 | 60 | X |

FIG. 5B

| TIME | TOTAL ELECTRIC POWER-CONSUMPTION | FOURTH HEAD | THIRD HEAD | SECOND HEAD | FIRST HEAD |
|---|---|---|---|---|---|
| | | 40 | 60 | 50 | 60 |
| t1 | 160 | 40 | 60 | X | 60 |
| t2 | 150 | 40 | X | 50 | 60 |
| t3 | 110 | X | 60 | 50 | X |

FIG. 5C

| TIME | TOTAL ELECTRIC POWER-CONSUMPTION | FOURTH HEAD | THIRD HEAD | SECOND HEAD | FIRST HEAD |
|---|---|---|---|---|---|
| | | 40 | 50 | 60 | 60 |
| t1 | 150 | 40 | 50 | X | 60 |
| t2 | 160 | 40 | X | 60 | 60 |
| t3 | 110 | X | 50 | 60 | X |

FIG. 5D

| TIME | TOTAL ELECTRIC POWER-CONSUMPTION | FOURTH HEAD | THIRD HEAD | SECOND HEAD | FIRST HEAD |
|---|---|---|---|---|---|
| | | 50 | 40 | 60 | 60 |
| t1 | 150 | 50 | 40 | X | 60 |
| t2 | 170 | 50 | X | 60 | 60 |
| t3 | 100 | X | 40 | 60 | X |

FIG. 5E

| TIME | TOTAL ELECTRIC POWER-CONSUMPTION | FOURTH HEAD | THIRD HEAD | SECOND HEAD | FIRST HEAD |
|---|---|---|---|---|---|
| | | 50 | 60 | 40 | 60 |
| t1 | 170 | 50 | 60 | X | 60 |
| t2 | 150 | 50 | X | 40 | 60 |
| t3 | 100 | X | 60 | 40 | X |

FIG. 5F

| TIME | TOTAL ELECTRIC POWER-CONSUMPTION | FOURTH HEAD | THIRD HEAD | SECOND HEAD | FIRST HEAD |
|---|---|---|---|---|---|
| | | 60 | 50 | 40 | 60 |
| t1 | 170 | 60 | 50 | X | 60 |
| t2 | 160 | 60 | X | 40 | 60 |
| t3 | 90 | X | 50 | 40 | X |

FIG. 8A

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 40 | 60 | 60 | 60 | 50 |
| t1 | 150 | 40 | X | 60 | X | 50 |
| t2 | 120 | X | 60 | X | 60 | X |

FIG. 8B

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 40 | 60 | 60 | 50 | 60 |
| t1 | 160 | 40 | X | 60 | X | 60 |
| t2 | 110 | X | 60 | X | 50 | X |

FIG. 8C

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 40 | 60 | 50 | 60 | 60 |
| t1 | 150 | 40 | X | 50 | X | 60 |
| t2 | 120 | X | 60 | X | 60 | X |

FIG. 8D

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 40 | 50 | 60 | 60 | 60 |
| t1 | 160 | 40 | X | 60 | X | 60 |
| t2 | 110 | X | 50 | X | 60 | X |

FIG. 8E

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 60 | 40 | 60 | 60 | 50 |
| t1 | 170 | 60 | X | 60 | X | 50 |
| t2 | 100 | X | 40 | X | 60 | X |

FIG. 8F

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 60 | 60 | 40 | 50 | 60 |
| t1 | 160 | 60 | X | 40 | X | 60 |
| t2 | 110 | X | 60 | X | 50 | X |

FIG. 8G

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 60 | 60 | 50 | 40 | 60 |
| t1 | 170 | 60 | X | 50 | X | 60 |
| t2 | 100 | X | 60 | X | 40 | X |

FIG. 8H

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 60 | 50 | 60 | 40 | 60 |
| t1 | 180 | 60 | X | 60 | X | 60 |
| t2 | 90 | X | 50 | X | 40 | X |

FIG. 10A

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 40 | 60 | 60 | 60 | 50 |
| t1 | 160 | 40 | 60 | 60 | X | X |
| t2 | 150 | 40 | 60 | X | X | 50 |
| t3 | 150 | 40 | X | X | 60 | 50 |
| t4 | 170 | X | X | 60 | 60 | 50 |
| t5 | 180 | X | 60 | 60 | 60 | X |

FIG. 10B

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 40 | 60 | 60 | 50 | 60 |
| t1 | 160 | 40 | 60 | 60 | X | X |
| t2 | 160 | 40 | 60 | X | X | 60 |
| t3 | 150 | 40 | X | X | 50 | 60 |
| t4 | 170 | X | X | 60 | 50 | 60 |
| t5 | 170 | X | 60 | 60 | 50 | X |

FIG. 10C

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 40 | 60 | 50 | 60 | 60 |
| t1 | 150 | 40 | 60 | 50 | X | X |
| t2 | 160 | 40 | 60 | X | X | 60 |
| t3 | 160 | 40 | X | X | 60 | 60 |
| t4 | 170 | X | X | 50 | 60 | 60 |
| t5 | 170 | X | 60 | 50 | 60 | X |

FIG. 10D

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 40 | 50 | 60 | 60 | 60 |
| t1 | 150 | 40 | 50 | 60 | X | X |
| t2 | 150 | 40 | 50 | X | X | 60 |
| t3 | 160 | 40 | X | X | 60 | 60 |
| t4 | 180 | X | X | 60 | 60 | 60 |
| t5 | 170 | X | 50 | 60 | 60 | X |

FIG. 11A

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 50 | 60 | 60 | 60 | 50 |
| t1 | 170 | 50 | 60 | 60 | X | X |
| t2 | 160 | 50 | 60 | X | X | 50 |
| t3 | 160 | 50 | X | X | 60 | 50 |
| t4 | 170 | X | X | 60 | 60 | 50 |
| t5 | 180 | X | 60 | 60 | 60 | X |

FIG. 11B

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 50 | 60 | 60 | 50 | 60 |
| t1 | 170 | 50 | 60 | 60 | X | X |
| t2 | 170 | 50 | 60 | X | X | 60 |
| t3 | 160 | 50 | X | X | 50 | 60 |
| t4 | 170 | X | X | 60 | 50 | 60 |
| t5 | 170 | X | 60 | 60 | 50 | X |

FIG. 11C

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 50 | 60 | 50 | 60 | 60 |
| t1 | 160 | 50 | 60 | 50 | X | X |
| t2 | 170 | 50 | 60 | X | X | 60 |
| t3 | 170 | 50 | X | X | 60 | 60 |
| t4 | 170 | X | X | 50 | 60 | 60 |
| t5 | 170 | X | 60 | 50 | 60 | X |

FIG. 11D

| TIME | TOTAL ELECTRIC POWER-CONSUMPTION | FIFTH HEAD | FOURTH HEAD | THIRD HEAD | SECOND HEAD | FIRST HEAD |
|---|---|---|---|---|---|---|
| | | 50 | 50 | 60 | 60 | 60 |
| t1 | 160 | 50 | 50 | 60 | X | X |
| t2 | 160 | 50 | 50 | X | X | 60 |
| t3 | 170 | 50 | X | X | 60 | 60 |
| t4 | 180 | X | X | 60 | 60 | 60 |
| t5 | 170 | X | 50 | 60 | 60 | X |

RECORDING METHOD AND RECORDING APPARATUS

BACKGROUND OF THE INVENTION

1. Field of the Invention

The present invention relates to a recording method and a recording apparatus which achieve recording with a low electrical power consumption.

2. Description of the Related Art

In an image recording apparatus, full-line type recording heads (recording devices) have been used, that is, recording heads extending along the entire width of a recording region on a recording medium are used. As such full-line type recording heads, there are line-type inkjet recording heads and LED type recording heads, etc. Any of these full-line type recording heads can record high-resolution images at a high speed by making use of line-type characteristics.

In the full-line type recording heads, the number of nozzles is 7200 per one recording head, for example. For forming images, the recording apparatus has individual heads for cyan ink, yellow ink, magenta ink and black ink.

However, in a recording apparatus using such full-line type inkjet recording heads, since the number of nozzles of the recording head is large, large electrical power is required for ink ejection. In particular, when simultaneously using the large number of nozzles (at a high recording duty-factor), the electrical power reaches its peak value.

Accordingly, corresponding to the peak value of the power consumption, a power supply capacity of the recording apparatus needs to be increased, resulting in increase in an overall apparatus cost.

SUMMARY OF THE INVENTION

It is an object of the present invention to provide a recording apparatus and a recording method in which the peak value of an electricity consumption is decreased when recording by using full-line type recording heads with each head having a different electricity consumption per one recording head.

Further objects, features and advantages of the present invention will become apparent from the following description of the preferred embodiments with reference to the attached drawings.

BRIEF DESCRIPTION OF THE DRAWINGS

FIGS. 3A–3E are tables showing the comparison of electrical power consumptions in the fifth embodiment.

FIGS. 5A–5F are tables showing the comparison of electrical power consumptions in the third embodiment.

FIGS. 8A–8H are tables showing the comparison of electrical power consumptions in the fourth embodiment.

FIGS. 10A–10D are tables showing the comparison of electrical power consumptions in a second embodiment.

FIGS. 11A–11D are tables showing the comparison of electrical power consumptions in the first embodiment.

DESCRIPTION OF THE PREFERRED EMBODIMENTS

Figure 1:
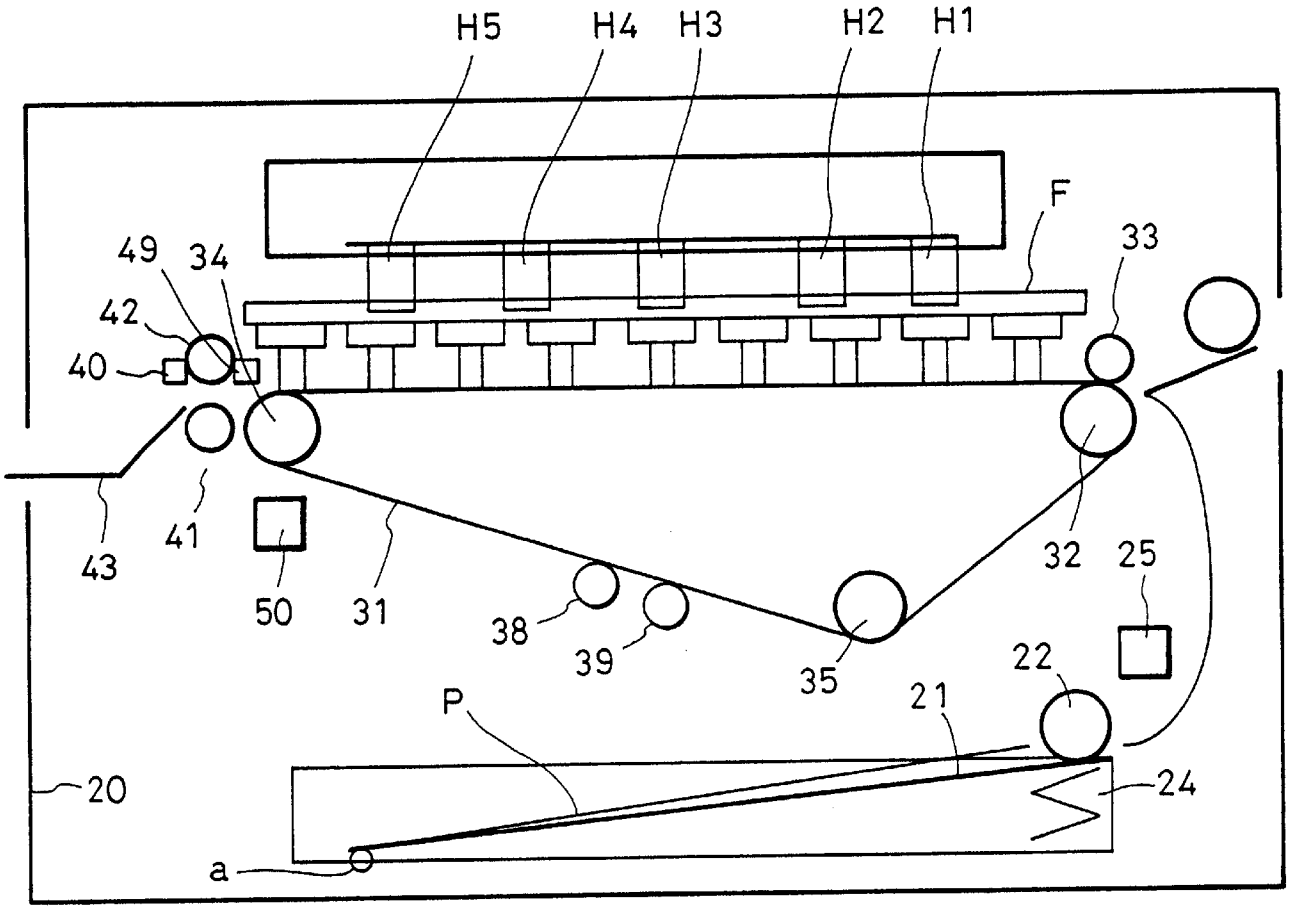
FIG. 1 is a sectional view of an entire mechanical structure of a recording apparatus.

FIG. 1 is a sectional view of an entire structure of a recording apparatus according to the present invention.

Referring to FIG. 1, a sheet feeding section, a transfer section, a recording head section, and a sheet discharge section will be described.

In the sheet feeding section, a pressure plate 21 for stacking recording sheets P and a feeding roller 22 for feeding the recording sheets P are rotatable about a rotational shaft connected to a base 20 and the pressure plate 21 is urged to the feeding roller 22 by a pressure plate spring 24. The pressure plate 21 is provided with a separating pad (not shown) made from a material with a high coefficient of friction for preventing piled-up feeding of the recording sheets P and a separating claw (not shown) for separating the recording sheets P one by one. There is provided a release cam (not shown) for releasing the abutment between the pressure plate 21 and the feeding roller 22.

In the structure mentioned above, the release cam pushes down the pressure plate 21 in a standby mode. The abutment between the pressure plate 21 and the feeding roller 22 is thereby released. When a driving force of a sheet-feeding motor 25 is transmitted to the feeding roller 22 and the release cam via gears, etc., the release cam is separated from the pressure plate 21. Thereby, the pressure plate 21 moves upwardly and the feeding roller 22 abuts the recording sheet P so as to pick up the recording sheet P along with the rotation of the feeding roller 22 and to start the sheet feeding. The feeding roller 22 rotates until the recording sheets P are fed to the transfer section.

The transfer section comprises a transfer belt 31 for holding and transferring the recording sheets P and a PE sensor (not shown).

The transfer belt 31 is driven by a driving roller 34 and looped over a transfer roller 32 and a tightening roller 35, which are follower rollers. A belt motor 50 drives the driving roller 34.

The transfer belt 31 is made from a synthetic resin such as polyethylene and is endless belt-shaped. Power dispatching means F applies a voltage of from 0.5 kV to 10 kV across the recording sheet P so as attract the sheet to the transfer belt (description of the power dispatching means, high-voltage generating means, and high-voltage controlling means is omitted).

The transfer belt 32 moves at a speed of 170 mm/sec in a recording mode.

At a position opposing the transfer roller 32, a pinch roller 33 is abutted, which follows the transfer belt 32. Recording heads H1, H2, H3, H4, and H5 are sequentially arranged in the transfer direction downstream of the transfer roller 32. Along the transfer direction, the recording head H1 is placed at the most upstream position while the recording head H5 is placed at the most downstream position. The distance between these recording heads is 10 cm.

Each recording head has a resolution of 600 DPI and employs a line-type ink-jet method having 7200 recording elements arranged in a direction perpendicular to the transfer direction.

Each recording element comprises a nozzle and a driving unit for applying heat to ink with a heater. The ink is film-boiled due to the heat and the ink pressure is changed by growth or contraction of bubbles due to the film boiling, so that the ink is ejected from the nozzle so as to form images on the recording sheet P.

There are two classes of the electrical power consumption of each recording head, as follows. A yellow recording head YH has a power consumption of 50 Wh; a magenta recording head MH has a power consumption of 60 Wh; a cyan recording head CH has a power consumption of 60 Wh; a light cyan recording head LCH has a power consumption of 50 Wh; and a black recording head KH has a power consumption of 60 Wh.

The value for each of the recording heads is the standard electrical power consumption when the entire 7200 nozzles eject ink in an environment with a room temperature of approximately from 10° C. to 30° C. The difference in the electrical power consumptions is due to the difference in volumes of one drop of ejected ink.

The electrical power consumption is assumed to be steady with little dependence on the room temperature.

The sheet discharge section comprises a discharge roller 41 and a spur 42, and the recording sheet P having images formed thereon is conveyed by the nip between the discharge roller 41 and the spur 42 pinched therebetween so as to be discharged into a discharge tray 43. The linear speed of the discharge roller 41 is substantially the same as that of the transfer belt, and the discharge roller 41 moves at a speed of 170 mm/sec in a recording mode.

A sheet discharge sensor 40 checks for the existence of the recording sheet P in the sheet discharge section. A separation sensor 49 is disposed in the discharge side of the belt 31 for checking for the existence of the transferred sheet.

A cleaning roller 38 is used for cleaning the belt 31. Numeral 39 denotes an electrostatic eliminating roller.

Figure 9:
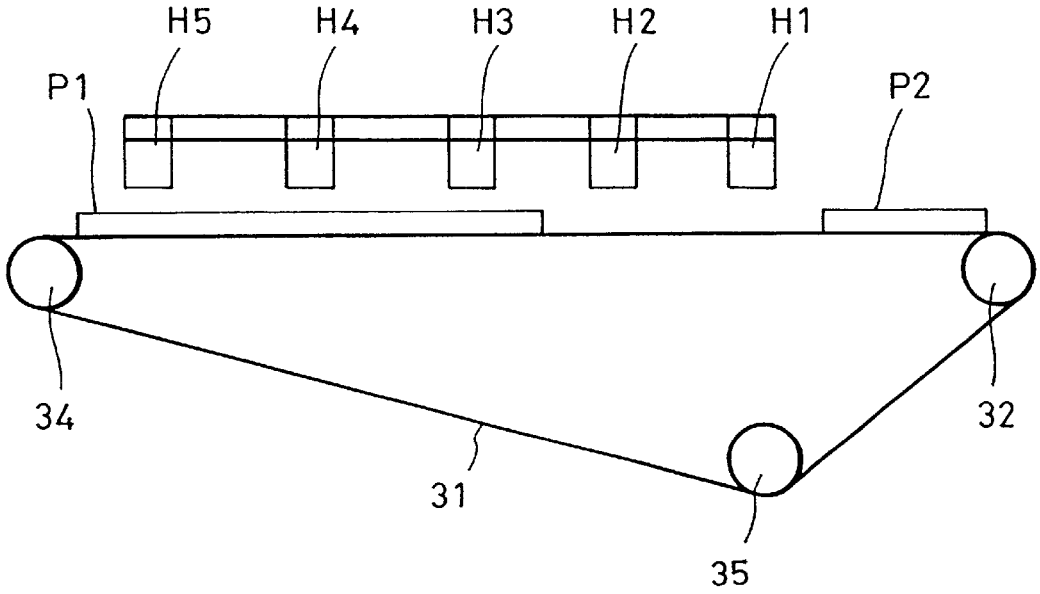
FIG. 9 is a sectional view of a recording apparatus according to the first embodiment showing the arrangement of five recording heads and positions of two pages of recording media.

FIG. 9 is a schematic representation of a state that two recording sheets P1 and P2 are transferred when the recording heads are spaced at equal intervals. The distance between adjacent recording heads is 10 cm. The recording sheet P1 is located under the recording heads H3, H4, and H5, from which ink is ejected. The recording sheet P2 is located more upstream and not yet under the recording head H1, and recording is not yet performed. The distance between the recording sheets P1 and P2 is 20 cm. Immediately under the recording heads H1 and H2, the recording sheet does not exist, so that those recording heads are not driven. In addition, the sheet feeding section feeds a recording sheet about every 1.18 sec so that the distance between the recording sheets P1 and P2 is to be 20 cm.

The recording sheets P1 and P2 are of A4 size, and the distance between leading and trailing edges is 210 mm.

The recording region initiates at 5 mm inside the leading edge and ends at 5 mm back from the trailing edge of the recording sheet.

In this case, for one page of the recording sheet, recording is simultaneously performed with a maximum of three recording heads.

The start-timing reference of ejection by each recording head is starting of the feeding roller 22.

In accordance with the distance from the feeding roller 22, the start timing of ejection is set.

Ejecting duration T is obtained by "the distance of the recording region in the transfer direction÷the speed of the transfer belt".

FIGS. 11A–11D show calculated results of the total amount of the electrical power consumption for every arrangement of the recording heads in the recording apparatus formed of five recording heads arranged at equal intervals as shown in FIG. 9.

A first head is H1; a second head is H2; a third head is H3; a fourth head is H4; and a fifth head is H5. Numerals at the top of the tables indicate electrical power consumptions of each head.

The total amount of the electrical power consumptions is obtained for four different arrangements of the recording heads as shown in FIGS. 11A–11D.

For example, in the arrangement of FIG. 11A, the amount of the electrical power consumption of the first head is 50 Wh; that of each of the second through fourth heads is 60 Wh; and that of the fifth head, which is the most downstream, is 50 Wh. From t1 to t5, the symbol x denotes a non-driven state.

When there is no recording sheet immediately under a recording head, that recording head is in a non-driven state.

Lapses of time indicated by t1→t2→t3→t4→t5 show the progress of the recording medium moving from upstream to downstream.

The t1 indicates a state that the recording heads H3, H4, and H5 are ejecting while the recording heads H1 and H2 are not driven. Similarly, t2 indicates a state that the recording heads H1, H4, and H5 are ejecting while the recording heads H2 and H3 are not driven; t3 indicates a state that the recording heads H1, H2, and H5 are ejecting while the recording heads H3 and H4 are not driven; t4 indicates a state that the recording heads H1, H2, and H3 are ejecting while the recording heads H4 and H5 are not driven; and t5 indicates a state that the recording heads H2, H3, and H4 are ejecting while the recording heads H1 and H5 are not driven.

From the comparison of the amounts of the electrical power consumptions, it is understood that the maximum electrical power consumption values are lowest in the arrangements of FIGS. 11B and 11C.

In the arrangements of FIGS. 11B and 11C, specifically in FIG. 11B, the black recording head KH is located at the position H1; the light cyan recording head LCH at the position H2; the cyan recording head CH at the position H3; the magenta recording head MH at the position H4; and the yellow recording head YH at the position H5.

Also, in FIG. 11C, the black recording head KH is located at the position H1; the cyan recording head CH at the position H2; the light cyan recording head LCH at the position H3; the magenta recording head MH at the position H4; and the yellow recording head YH at the position H5.

As described above, the peak value of the electrical power consumptions can be kept low by combining the recording heads which are simultaneously driven so as to be a combination of the recording heads with different electrical power consumptions. Furthermore, according to the embodiment, the combination of the recording heads is to be the combination between the recording head with the maximum electrical power consumption and the recording head with the minimum electrical power consumption, so that the electrical power consumption can be efficiently reduced.

Figure 6:
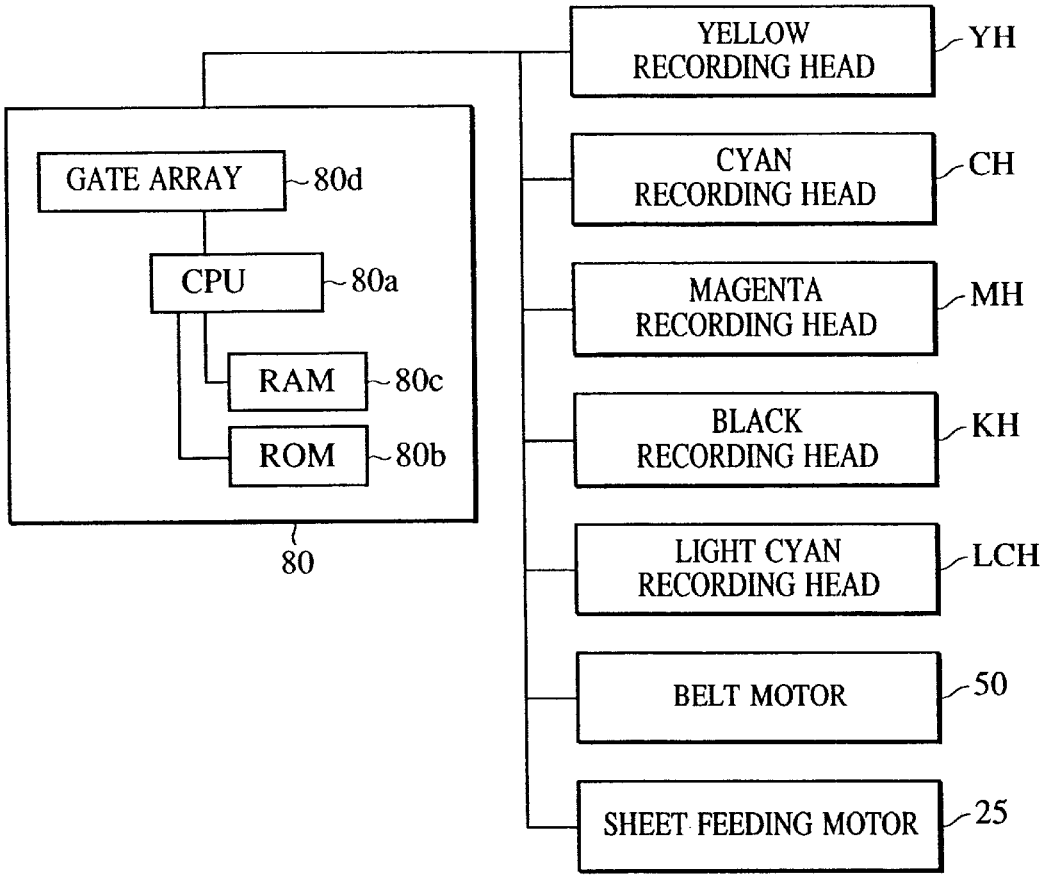
FIG. 6 is a block diagram of a control system according to a first embodiment.

FIG. 6 shows control blocks of the apparatus according to the present invention. A control section 80 comprises a CPU 80*a* which operates according to a control program, a ROM 80*b* for storing the program, and a RAM 80*c* which is a work memory. A gate array is an LSI for controlling the driving signal of the recording head, the holding means, the sheet feeding section, and the transfer section together with the CPU.

The control section 80 is connected to the belt motor 50 for driving the transfer belt, the sheet-feeding motor 25 which is a driving source of the feeding roller 22, the black recording head KH, the cyan recording head CH, the magenta recording head MH, the yellow recording head YH, and the light cyan recording head LCH.

According to a second embodiment, the recording heads have an arrangement shown in FIG. 9.

As the description of FIG. 9 is similar to that of the first embodiment, it is omitted. The electrical power consumptions of the recording heads have three classes as follows.

A yellow recording head YH has a power consumption of 40 Wh; a magenta recording head MH has a power consumption of 60 Wh; a cyan recording head CH has a power consumption of 60 Wh; a light cyan recording head LCH has a power consumption of 50 Wh; and a black recording head KH has a power consumption of 60 Wh.

FIGS. 10A–10D show calculated results of the total amount of the electrical power consumptions for every arrangement of the recording heads in the recording apparatus formed of five recording heads arranged at equal intervals.

A first head is H1; a second head is H2; a third head is H3; a fourth head is H4; and a fifth head is H5. Numerals at the top of the tables indicate electrical power consumptions of each head. The units of the numerals are Wh.

The total amount of the electrical power consumptions is obtained for four different arrangements of the recording heads as shown in FIGS. 10A–10D.

For example, in the arrangement of FIG. 10A, the amount of the electrical power consumption of the first head is 50 Wh; that of each of the second through fourth heads is 60 Wh; and that of the fifth head, which is the most downstream, is 40 Wh. From t1 to t5, the symbol x denotes a non-driven state.

When there is no recording medium immediately under a recording head, that recording head is in a non-driven state.

Lapses of time indicated by t1→t2→t3→t4→t5 show the progress of the recording medium moving from upstream to downstream.

The t1 indicates a state that the recording heads H3, H4, and H5 are ejecting while the recording heads H1 and H2 are not driven. Similarly, t2 indicates a state that the recording heads H1, H4, and H5 are ejecting while the recording heads H2 and H3 are not driven; t3 indicates a state that the recording heads H1, H2, and H5 are ejecting while the recording heads H3 and H4 are not driven; t4 indicates a state that the recording heads H1, H2, and H3 are ejecting while the recording heads H4 and H5 are not driven; and t5 indicates a state that the recording heads H2, H3, and H4 are ejecting while the recording heads H1 and H5 are not driven.

From the comparison of the amounts of the electrical power consumptions, it is understood that the electrical power consumption maximum values of the arrangements of FIGS. 10B and 10C are the lowest.

In the arrangements of FIGS. 10B and 10C, specifically in FIG. 10B, the black recording head KH is located at the position H1; the light cyan recording head LCH at the position H2; the cyan recording head CH at the position H3; the magenta recording head MH at the position H4; and the yellow recording head YH at the position H5.

Also, in FIG. 10C, the black recording head KH is located at the position H1; the cyan recording head CH at the position H2; the light cyan recording head LCH at the position H3; the magenta recording head MH at the position H4; and the yellow recording head YH at the position H5.

By the arrangements of FIGS. 10A and 10C, the combination of the recording heads which are simultaneously driven is of recording heads with different electrical power consumptions, so that the peak value of the electrical power consumptions can be efficiently reduced.

Furthermore, by combining the recording heads so that at least one of the recording heads is stopped driving, the peak value of the electrical power consumptions can be efficiently reduced.

Figure 4:
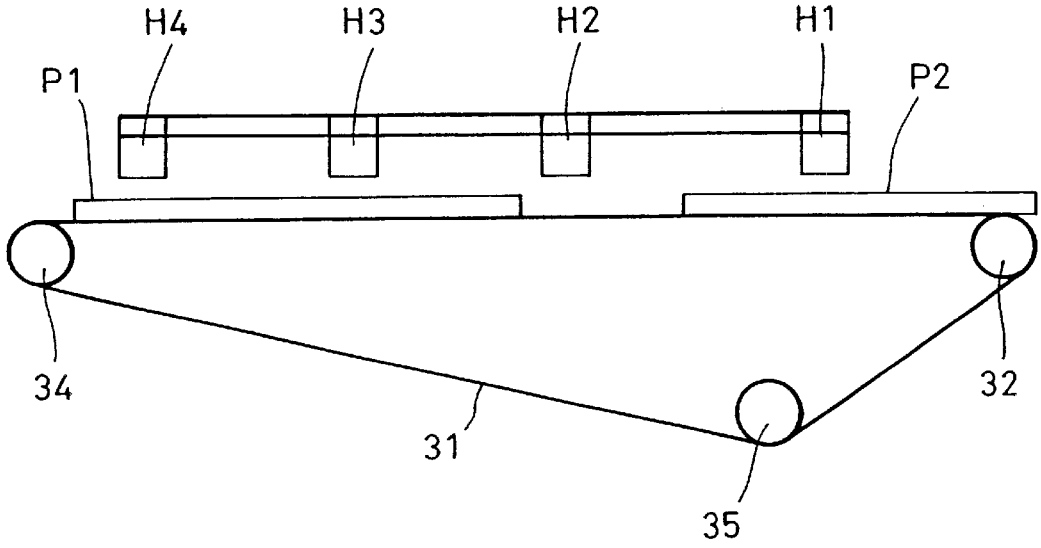
FIG. 4 is a sectional view of a recording apparatus according to a third embodiment showing the arrangement of four recording heads and positions of two pages of recording media.

According to a third embodiment, the recording heads have an arrangement shown in FIG. 4.

The electrical power consumptions of the recording heads have two classes as follows.

A yellow recording head YH has a power consumption of 40 Wh; a magenta recording head MH has a power consumption of 60 Wh; a cyan recording head CH has a power consumption of 60 Wh; and a black recording head KH has a power consumption of 50 Wh. The drawing is a schematic representation of a state that two recording sheets P1 and P2 are transferred when the four recording heads H1, H2, H3, and H4 are arranged at equal intervals. The distance between adjacent recording heads is 8 cm.

The recording sheet P1 is located under the recording heads H3 and H4, from which ink is ejected. The recording sheet P2 is located under the recording head H1 from which ink is ejected. The distance between the recording sheets P1 and P2 is 10 cm. Immediately under the recording head H2, a recording sheet does not exist, so that recording head is not driven. The sheet feeding section feeds a recording sheet about every 0.58 sec so that the distance between the recording sheets P1 and P2 is to be 10 cm.

The recording sheets P1 and P2 are of A5 size, and the distance between leading and trailing edges is 148 mm.

The recording region initiates at 5 mm inside the leading edge and ends at 5 mm back from the trailing edge of the recording sheet. In this case, for one page of the recording sheet, recording is simultaneously performed with a maximum number of two recording heads.

FIG. 5 shows calculated results of the total amount of the electrical power consumptions for every arrangement of the recording heads.

A first head is H1; a second head is H2; a third head is H3; and a fourth head is H4. Numerals at the top of the tables indicate electrical power consumption of each head. The units of the numerals are Wh.

The total amount of the electrical power consumptions is obtained for six arrangements of the recording heads as shown in FIGS. 5A to 5F.

From the comparison of the amounts of the electrical power consumptions, it is understood that the electrical power consumption maximum value of the arrangement of FIG. 5A is the lowest.

Specifically, the black recording head KH is located at the position H1; the cyan recording head CH at the position H2; the magenta recording head MH at the position H3; and the yellow recording head YH at the position H4.

In the arrangements of the recording heads, according to the embodiment, by arranging the recording head with the maximum electrical power consumption at a position other than those on the most upstream side and the most downstream side in the arranging direction of the recording heads, the peak value of the total electrical power consumptions can be reduced to the lowest.

Figure 7:
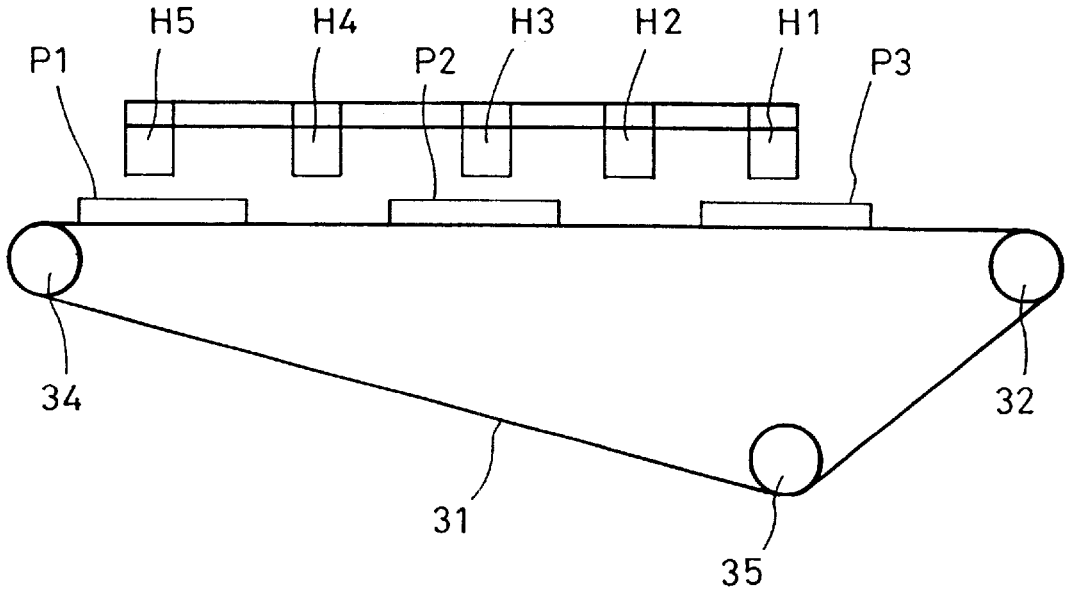
FIG. 7 is a sectional view of a recording apparatus according to a fourth embodiment showing the arrangement of five recording heads and positions of three pages of recording media.

According to a fourth embodiment, the recording heads have an arrangement shown in FIG. 7.

The drawing is a schematic representation of a state that three recording sheets P1, P2, and P3 are transferred when five recording heads H1, H2, H3, H4, and H5 are arranged at substantially equal intervals. The distance between adjacent recording heads is 10 cm.

The recording sheet P1 is located under the recording head H5; the recording sheet P2 under the recording head H3; and the recording sheet P3 under the recording head H1, from each of which ink is ejected. The distances between the sheets P1 and P2 and between the sheets P2 and P3 are 10 cm, respectively. Under the recording heads H2 and H4, a recording sheet does not exist, so those recording heads are not driven. The sheet feeding section feeds a recording sheet about every 0.58 sec, so that the distances between the sheets P1 and P2 and between the sheets P2 and P3 are to be 10 cm, respectively.

The recording sheets P1 and P2 are of A6 size, and the distance between leading and trailing edges is 105 mm.

The recording region initiates at 5 mm inside the leading edge and ends at 5 mm back from the trailing edge of the recording sheet.

In this case, for one page of the recording sheet, recording is performed with one recording head.

The electrical power consumptions of the recording heads have three classes as follows.

A yellow recording head YH has a power consumption of 40 Wh; a magenta recording head MH has a power consumption of 60 Wh; a cyan recording head CH has a power consumption of 60 Wh; a light cyan recording head LCH has a power consumption of 50 Wh; and a black recording head KH has a power consumption of 60 Wh.

FIG. 8 shows calculated results of the total amount of the electrical power consumptions in the cases that three recording sheets are continuously transferred, and two recording sheets are transferred in the recording apparatus formed of five recording heads.

A first head is H1; a second head is H2; a third head is H3; a fourth head is H4; and a fifth head is H5. Numerals at the top of the tables indicate electrical power consumptions of each head. The units of the numerals are Wh.

The total amount of the electrical power consumptions is obtained for eight arrangements of the recording heads as shown in FIGS. 8A–8H.

For example, in the arrangement of FIG. 8A, the amount of the electrical power consumption of the first head is 50 Wh; that of each of the second through fourth heads is 60 Wh; and that of the fifth head, which is the most downstream, is 40 Wh. In t1 and t2, the symbol x denotes a non-driven state.

When there is no recording sheet immediately under a recording head, that recording head is in a non-driven state.

A lapse of time indicated by t1→t2 shows the progress of the recording medium moving from upstream to downstream.

In the state shown in FIG. 8A, t1 indicates a state that the recording heads H1, H3, and H5 are ejecting while the recording heads H2 and H4 are not driven. Similarly, t2 indicates a state that the recording heads H2 and H4 are ejecting while the recording heads H1, H3, and H5 are not driven.

From the comparison of the total amounts of the electrical power consumptions, it is understood that the electrical power consumption maximum values of the arrangements of FIGS. 8A and 8C are the lowest. Specifically, in FIG. 8A, the light cyan recording head LCH is located at the position H1; the black recording head KH at the position H2; the cyan recording head CH at the position H3; the magenta recording head MH at the position H4; and the yellow recording head YH at the position H5.

Also, in FIG. 8C, the black recording head KH is located at the position H1; the cyan recording head CH at the position H2; the light cyan recording head LCH at the position H3; the magenta recording head MH at the position H4; and the yellow recording head YH at the position H5.

As in FIG. 8A, by arranging the recording head with the maximum electrical power consumption at a position other than those on the most upstream side and the most downstream side, the peak value of the total electrical power consumptions can be reduced to the lowest.

Figure 2:
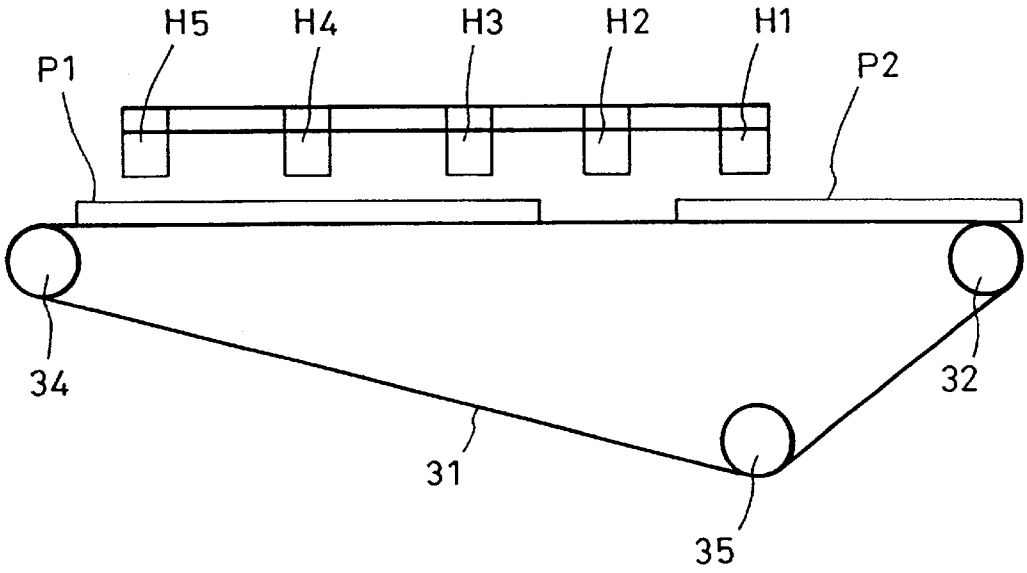
FIG. 2 is a sectional view of a recording apparatus according to a fifth embodiment showing the arrangement of five recording heads and positions of two pages of recording media.

According to a fifth embodiment, the recording heads have an arrangement as shown in FIG. 2. FIG. 2 is a schematic representation of a state that two recording sheets P1 and P2 are transferred when recording heads are arranged at equal intervals. The distance between adjacent recording heads is 10 cm.

The recording sheet P1 is located under the recording heads H3, H4, and H5, from each of which ink is ejected; and the recording sheet P2 is located under the recording head H1, from which ink is ejected. The distance between the sheets P1 and P2 is 10 cm. Immediately under the recording head H2, a recording sheet does not exist, so that recording head is not driven. The sheet feeding section feeds a recording sheet about every 0.58 sec, so that the distance between the sheets P1 and P2 is 10 cm.

The recording sheets P1 and P2 are of A4 size, and the distance between leading and trailing edges is 210 mm.

The recording region initiates at 5 mm inside the leading edge and ends at 5 mm back from the trailing edge in the transfer direction.

In this case, for one page of the recording sheet, recording is performed with a maximum number of three recording heads.

A yellow recording head YH has a power consumption of 50 Wh; a magenta recording head MH has a power consumption of 60 Wh; a cyan recording head CH has a power consumption of 60 Wh; a light cyan recording head LCH has a power consumption of 50 Wh; and a black recording head KH has a power consumption of 60 Wh.

FIGS. 3A–3E show calculated results of the total amount of the electrical power consumptions in the arrangement shown in FIG. 2. A first head is H1; a second head is H2; a third head is H3; a fourth head is H4; and a fifth head is H5. Numerals at the top of the tables indicate electrical power consumption of each head. The units of the numerals are Wh.

The total amount of the electrical power consumptions is obtained for the five arrangements of the recording heads shown in FIGS. 3A to 3E.

For example, in the arrangement of FIG. 3A, the amount of the electrical power consumption of the first head is 50 Wh; that of each of the second through fourth heads is 60

Wh; and that of the fifth head, which is the most downstream, is 50 Wh. In t1 and t2, the symbol x denotes a non-driven state.

When there is no recording sheet immediately under a recording head, that recording head is in a non-driven state.

Lapses of time indicated by t1→t2→t3→t4 show the progress of the recording medium moving from upstream to downstream.

In the state of FIG. 3A, t1 indicates a state that the recording heads H1, H3, H4, and H5 are ejecting while the recording head H2 is not driven. Similarly, t2 indicates a state that the recording heads H1, H2, H4, and H5 are ejecting while the recording head H3 is not driven; t3 indicates a state that the recording heads H1, H2, H3, and H5 are ejecting while the recording head H4 is not driven; and t4 indicates a state that the recording heads H2, H3, and H4 are ejecting while the recording heads H1 and H5 are not driven.

The total amount of electrical power consumption is 220 Wh from t1 to t3, and 180 Wh at t4.

From the comparison of the total amounts of the electrical power consumptions, it is understood that the electrical power consumption maximum value of the arrangement of FIG. 3A is the lowest.

Specifically, the light cyan recording head LCH is located at the position H1; the black recording head KH at the position H2; the cyan recording head CH at the position H3; the magenta recording head MH at the position H4; and the yellow recording head YH at the position H5.

In the arrangement of the recording heads, by arranging the recording head with the maximum electrical power consumption at a position other than those on the most upstream side and the most downstream side, the peak value of the total electrical power consumptions can be reduced to the lowest.

From a different point of view, in the arrangement of the recording heads, by arranging the recording heads with the minimum electrical power consumptions at positions on the most upstream side and the most downstream side, the peak value of the total electrical power consumption can be reduced to the lowest.

In the embodiments described above, the recording sheet has been described as an example of a recording medium; however, it may be an OHP sheet or cloth.

The driving unit of the recording element in each of the embodiments is an electro-thermal converter for generating heat to ink with a heater, etc.; however, a piezo-element, for example, may be substituted for the electro-thermal converter.

As for the resolution of the recording head, other than 600 DPI, it may be a higher resolution such as 1200 DPI or a lower resolution such as 360 DPI.

The number of recording heads which are not driven on an interspace between adjacent recording media may be 3 or more.

Also, the number of classes of the recording heads with different electrical power consumptions may be 4 or more.

The number of recording heads used in recording also is not limited to 4 and 5.

Plural recording heads with the same colors may be used. The relationship between the color of the recording head and electrical power consumption is not limited to that in the embodiments; a head for ejecting black ink may have two classes of electrical power consumptions, for example.

The electrical power consumption of the recording head has been defined in the case when the entire nozzles eject ink simultaneously; however, it may be in another state such as an operational state that one nozzle is thinned out.

The cause of the difference in the electrical power consumption is not limited to the difference in a volume of one ejected ink drop; it may be due to a circuit structure within the recording head or a driving method.

The transfer speed is not limited to 170 mm/sec; it may be a higher speed.

The distance between recording media is not limited to those mentioned above, and the time interval of sheet-feeding operation is not also limited thereto as long as "time=distance between recording media÷transfer speed".

The recording head may be not only an ink jet head, but also a recording device employing an LED array.

A transfer detecting sensor on a transfer line closer to the recording head than the feed roller may be used for the timing reference of ejection.

As described above, according to the present invention, in a recording apparatus formed of plural recording heads with different electrical power consumptions, when recording with the recording heads to be driven which are combined so as to be a combination of the recording heads with different electrical power consumptions, the total amount of electrical power consumptions can be reduced.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus having recording heads arranged in a transfer direction of recording media for simultaneously recording on a plurality of the recording media, the recording apparatus comprising:

transfer means;

control means for controlling the transfer means to transfer the plurality of the recording media so as to be spaced from each other; and recording head control means for controlling so that at least one recording head is driven for one recording medium while at least one recording head with the maximum electrical power consumption is stopped on an interspace between adjacent recording media which are transferred.

2. A recording apparatus capable of simultaneously recording on a plurality of recording media using a plurality of recording heads with different electrical power consumptions, the recording apparatus comprising:

transfer means; and control means for controlling the transfer means so as to transfer the recording media in a transferring direction, wherein recording heads with minimum electrical power consumptions are arranged on the most upstream side and the most downstream side in the transferring direction of the recording media.

3. A recording apparatus capable of simultaneously recording on a plurality of recording media using a plurality of recording heads with different electrical power consumptions, the recording apparatus comprising:

transfer means; and control means for controlling the transfer means so as to transfer the recording media in a transferring direction, wherein the recording head with a maximum electrical power consumption is arranged at a position other than positions at the most upstream side and the most downstream side in the transferring direction of the recording media.

4. A recording apparatus according to any one of claims 1, 2 and 3, wherein the recording heads with different electrical power consumptions have respective specific values of electrical power consumption.

5. A recording apparatus according to any one of claims 1, 2 and 3, wherein the recording heads are arranged at equal intervals in the transfer direction.

6. A recording apparatus according to any one of claims 1, 2, and 3, wherein the control means for controlling the transfer means controls transfer of the recording media so as to be spaced from each other at equal intervals.

7. A recording apparatus according to any one of claims 1, 2, and 3, wherein each recording head comprises a plurality of recording elements arranged along a direction intersecting the transferring direction of the recording media.

8. A recording apparatus according to claim 7, wherein each of the recording elements comprises an electro-thermal converter for generating thermal energy for ejecting ink.

9. A method for recording using a recording apparatus capable of simultaneously recording on a plurality of recording media with a plurality of recording heads having different electrical power consumptions, the method comprising the steps of:

transferring the recording media in a transferring direction; and recording on the recording media using recording heads with a minimum electrical power consumption, which are respectively arranged on the most upstream side and the most downstream side in the transferring direction.

10. A recording method according to claim 9, wherein the recording heads with different electrical power consumptions have respective specific values of electrical power consumption.

11. A recording method according to claim 9, wherein the recording heads are arranged at equal intervals in the transfer direction.

12. A recording method according to claim 9, wherein each of the recording heads comprises a plurality of recording elements arranged in a direction intersecting the transferring direction of the recording media.

13. A recording method according to claim 12, wherein each of the recording elements comprises an electro-thermal converter for generating thermal energy for ejecting ink.

* * * * *